US005742939A

United States Patent [19]

Williams

[11] Patent Number: 5,742,939

[45] Date of Patent: Apr. 28, 1998

[54] PLAY COSTUME WITH DETACHABLE PADS

[76] Inventor: Stan Williams, 180 Fashion Park Pl., Oxnard, Calif. 93033

[21] Appl. No.: 519,002

[22] Filed: Aug. 24, 1995

[51] Int. Cl.[6] ..... A41D 1/00; A41D 13/00; A63H 33/00

[52] U.S. Cl. ..... 2/69; 2/456; 2/908; 2/912; 446/28; 446/401

[58] Field of Search ..... 2/2, 69, 72, 75, 2/80, 158, 905, 16, 22, 23, 24, 455, 456, 463, 464, 466, 467; D2/741, 745, 746, 750; 446/26, 28, 401, 473, 484

[56] References Cited

U.S. PATENT DOCUMENTS

| | | | |
|---|---|---|---|
| 540,045 | 5/1895 | Casparian . | |
| 2,412,241 | 12/1946 | Abrahamson | 2/80 |
| 3,060,625 | 10/1962 | Glass et al. | 446/26 |
| 3,319,260 | 5/1967 | Cummins . | |
| 3,446,880 | 5/1969 | Enicks . | |
| 3,991,420 | 11/1976 | Savarino | 2/16 X |
| 4,441,211 | 4/1984 | Donzis | 2/22 X |
| 4,517,230 | 5/1985 | Crawford . | |
| 4,561,123 | 12/1985 | Hull | 2/16 X |
| 4,722,098 | 2/1988 | Stapleton . | |
| 4,792,471 | 12/1988 | Lee . | |
| 4,800,592 | 1/1989 | Cable . | |
| 4,980,929 | 1/1991 | Long | 2/158 X |
| 5,046,986 | 9/1991 | Wood et al. | 2/69 X |
| 5,389,033 | 2/1995 | Rauch | 446/473 |
| 5,394,565 | 3/1995 | Stewart et al. | 446/28 X |
| 5,484,316 | 1/1996 | Poirer | 446/28 |
| 5,516,321 | 5/1996 | Kornbleuth | 2/158 X |

*Primary Examiner*—Paul C. Lewis
*Attorney, Agent, or Firm*—Dowell & Dowell

[57] ABSTRACT

A play costume is comprised of a plurality of pads detachably mountable on body worn apparel. Optional items such as a belt and carrying bag with a draw string for transporting and storing the play costume parts may be packaged with the play costume as part of a costume kit. Further peripherals which may be included with the costume include: an integral sound system, interchangeable pads, simulated weapons, infrared detection systems, a powered simulated eye patch, interchangeable program cartridges and an integral light system.

19 Claims, 15 Drawing Sheets

FIG. 3
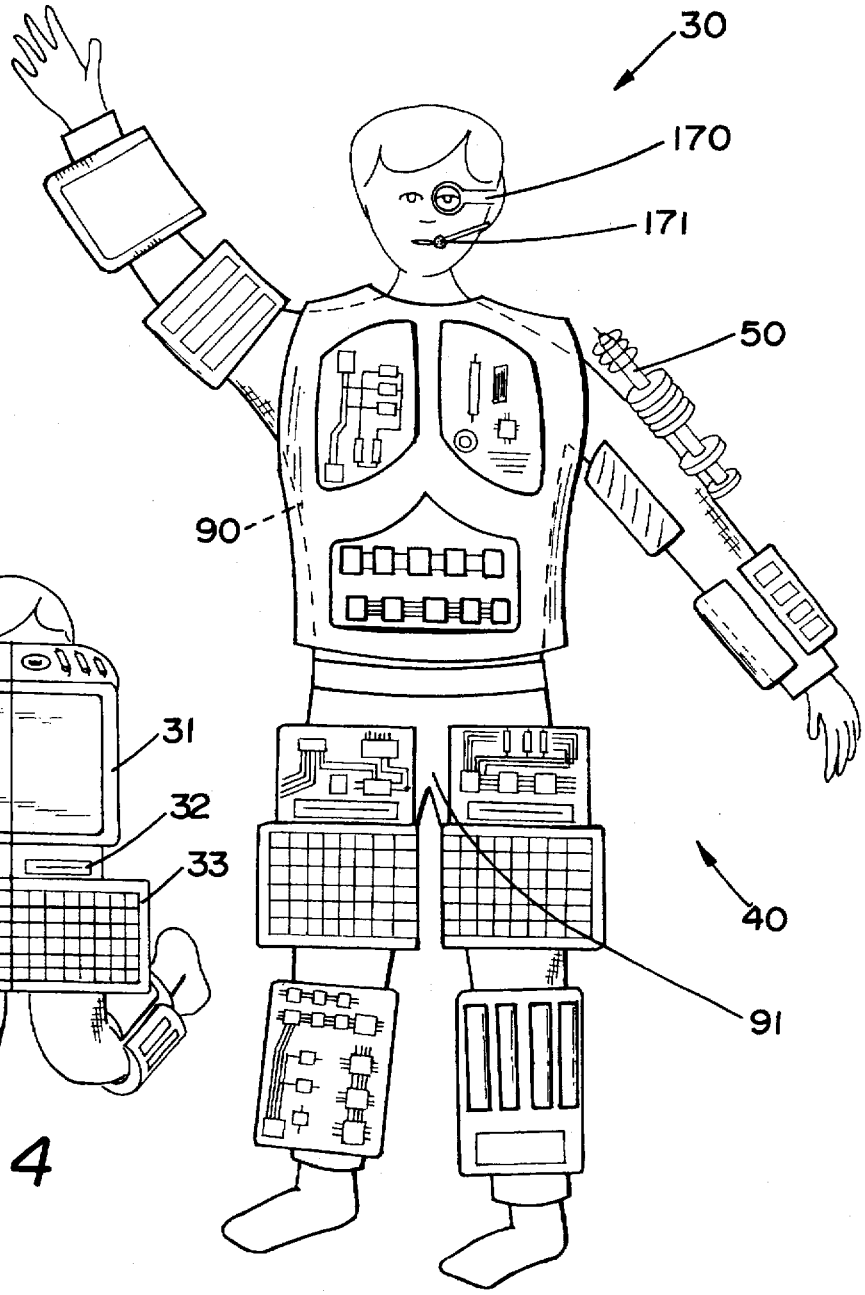
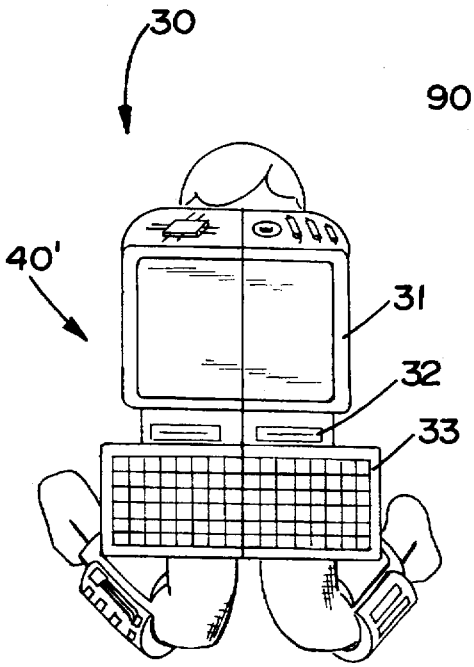
FIG. 4

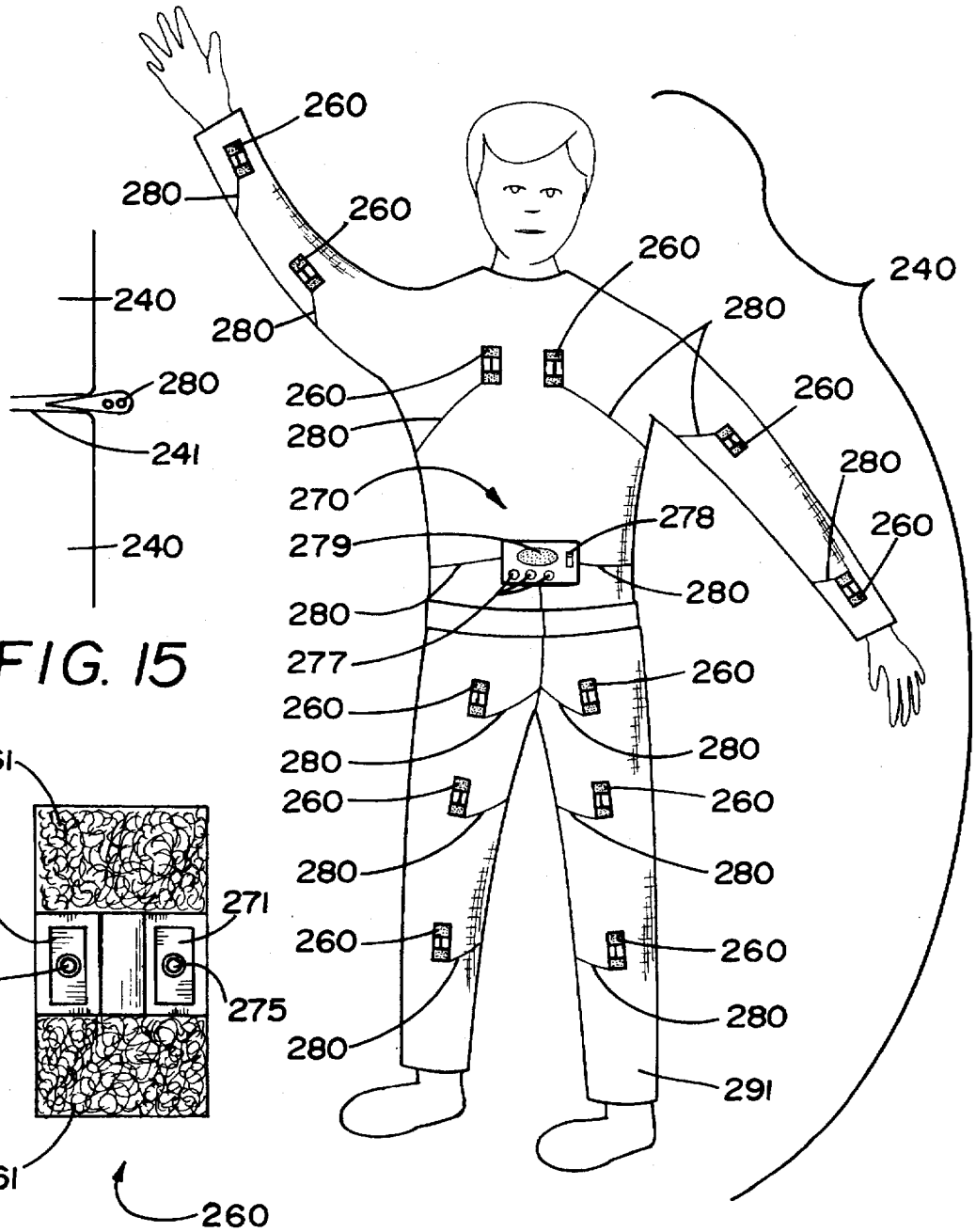
FIG. 15
FIG. 14
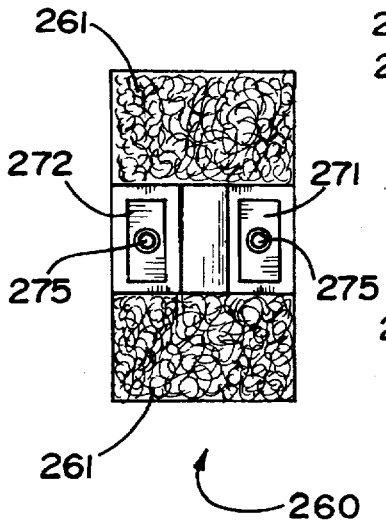
FIG. 16

FIG. 20
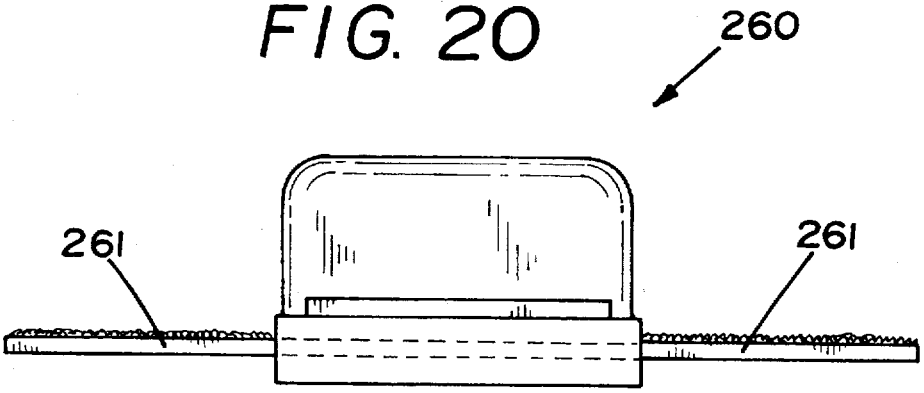
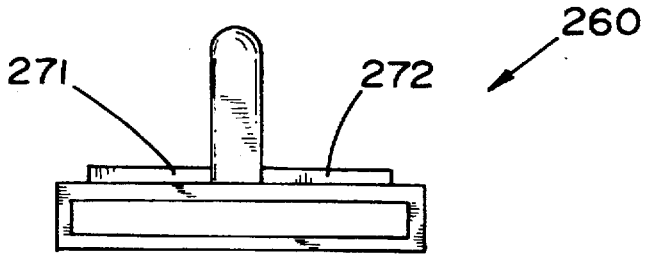
FIG. 21
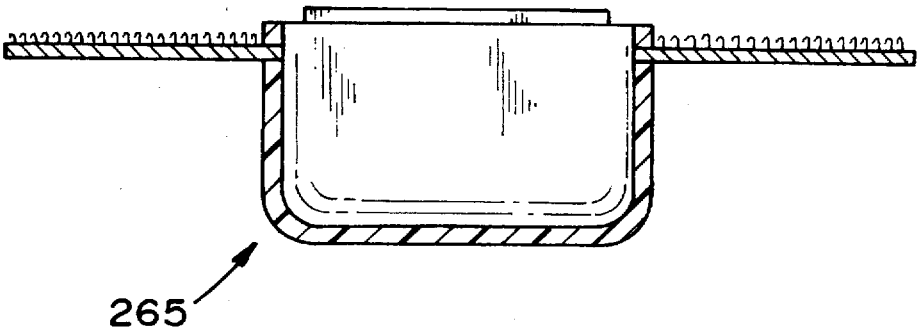
FIG. 22

PLAY COSTUME WITH DETACHABLE PADS

BACKGROUND OF THE INVENTION

1. Field of the Invention

This invention is generally directed to costume clothing for children and, more particularly, to a child's costume having a plurality of pads which are detachable by sufficient force being applied against the costume by another child.

2. Description of Related Art

Many different costumes are known, particularly for use on special occasions such as Halloween. Typically, the known costumes are intended to be worn by children and, for this reason, tend to be simulative of various ghouls, animals, and assorted well known characters and historical figures. The known costumes are usually designed and constructed for appearance only, offering little latitude in their intended use. For example, children are usually unable to physically and actively play in the known costumes without the likelihood of damage to the costume and/or to the child. The known costumes also offer little, if any, variation in their construction, in terms of being able to transform into different shapes, to change characters or to alter the physical appearance of the character the costume is intended to represent. Also, the known costumes do not offer interactive sound activated as various parts of the costume are contacted or detached.

Thus, there is a need for a costume which overcomes and eliminates the above and other inadequacies of the known costumes. There is also a need for a children's costume in which a child can play without fear of hurting his or herself and/or the costume. There is further need for a costume which can transform from being simulative of one shape or character into being simulative of an alternative shape or character. There is also a need for a costume which has interactive sound capabilities such that, when contact is made with the costume, entertaining sounds are produced.

SUMMARY OF THE INVENTION

In accordance with the present invention, a play costume is provided having a plurality of detachable arm, leg, and torso pads. A preferred embodiment of the costume includes a built-in interactive sound system. The detachable pads, preferably constructed from a foam rubber material, attach to the arms, legs, and torso of a child in such a fashion that other children can playfully dislodge the pads during a mock fight, while the electronic sound system, which includes sensors and an electronic control module, is activated as various parts of the costume are contacted or as pads are dislodged.

In one preferred embodiment of the costume, the various padded elements are attached to the costume in such a manner that when a person wearing the costume moves from a standing position into a different position, such as a crouched position, the suit takes on a special configuration simulative of some type of object or character distinctly different from the configuration when the wearer is in a standing position.

The padded portions are attachable and detachable from specially constructed body worn apparel, preferably through the utilization of a plurality of coacting "hook" and "loop" thistle-type fastening elements (e.g. VELCRO™) mounted thereon and releasably engageable with each other upon disposition of the pads onto corresponding sections of the body worn pieces. If a child falls to the ground, the pads can provide protection against injury.

Accessories such as a belt and carrying bag can also be utilized with the play costume. The belt is preferably constructed from an adjustable elastic band which fits around the user's waist and is secured by hook and loop fastening elements. In addition, the belt has fastening elements fixed at various points along the band onto which optional accessories can be attached. The carrying bag enables all of the individual pieces of the play costume to be kept together, carried, and stored for future use without loss.

Accordingly, it is an object of the present invention to provide a new interactive play costume having detachable arms, legs, and torso pads constructed from a resilient, deformable material.

Another object of the invention is to provide both human and non-human simulative play costumes which are comfortably worn without limiting the wearer's freedom of movement or physical capabilities.

Another object of the invention is to provide a play costume having an interactive sound system which is activated by contact being made with various pads of the play costume or detachment of the pads.

Another object of the invention is to provide a play costume having an infrared system which can activate the sound system by using an infrared transmitter aimed at various infrared sensors located on the detachable pads.

Another object of the invention is to provide a play costume having a light system integrated into the sound system in which lights are lit as targets or infrared sensors are activated or as contact is made with a body pad.

Yet another object of the invention is to provide a costume or play suit using readily available, easily manufactured and inexpensive materials.

BRIEF DESCRIPTION OF THE DRAWINGS

The foregoing and other objects of the present invention will become apparent from the following description and the accompanying drawings, in which:

FIG. 3 is a front elevational view of an individual in a standing position wearing a play costume, in accordance with another embodiment of the present invention;

FIG. 4 is a front elevational view of an individual in a crouched and kneeling position wearing the play costume of FIG. 3;

FIG. 14 is a front elevational view showing an individual wearing a portion of another embodiment of a play suit in accordance with the present invention, including a shirt, pants, electronic control module, wires, electrical sensors, and fastening elements arranged for securing the body pads to the wearer's clothes;

FIG. 15 is an enlarged cross-sectional view of a portion of the play costume of FIG. 14 illustrating a seam containing electrical wires;

FIG. 16 is an enlarged view showing a portion of the play costume of FIG. 14 including an electrical sensor and a fastening element;

FIG. 20 is an enlarged view showing an electrical pad sensor and a fastening element in accordance with the present invention;

FIG. 21 is an end view of the electrical pad sensor of FIG. 20;

FIG. 22 is an enlarged view showing an electrical body piece sensor and a fastening element in accordance with the present invention;

DETAILED DESCRIPTION OF THE PREFERRED EMBODIMENTS

Figure 1:
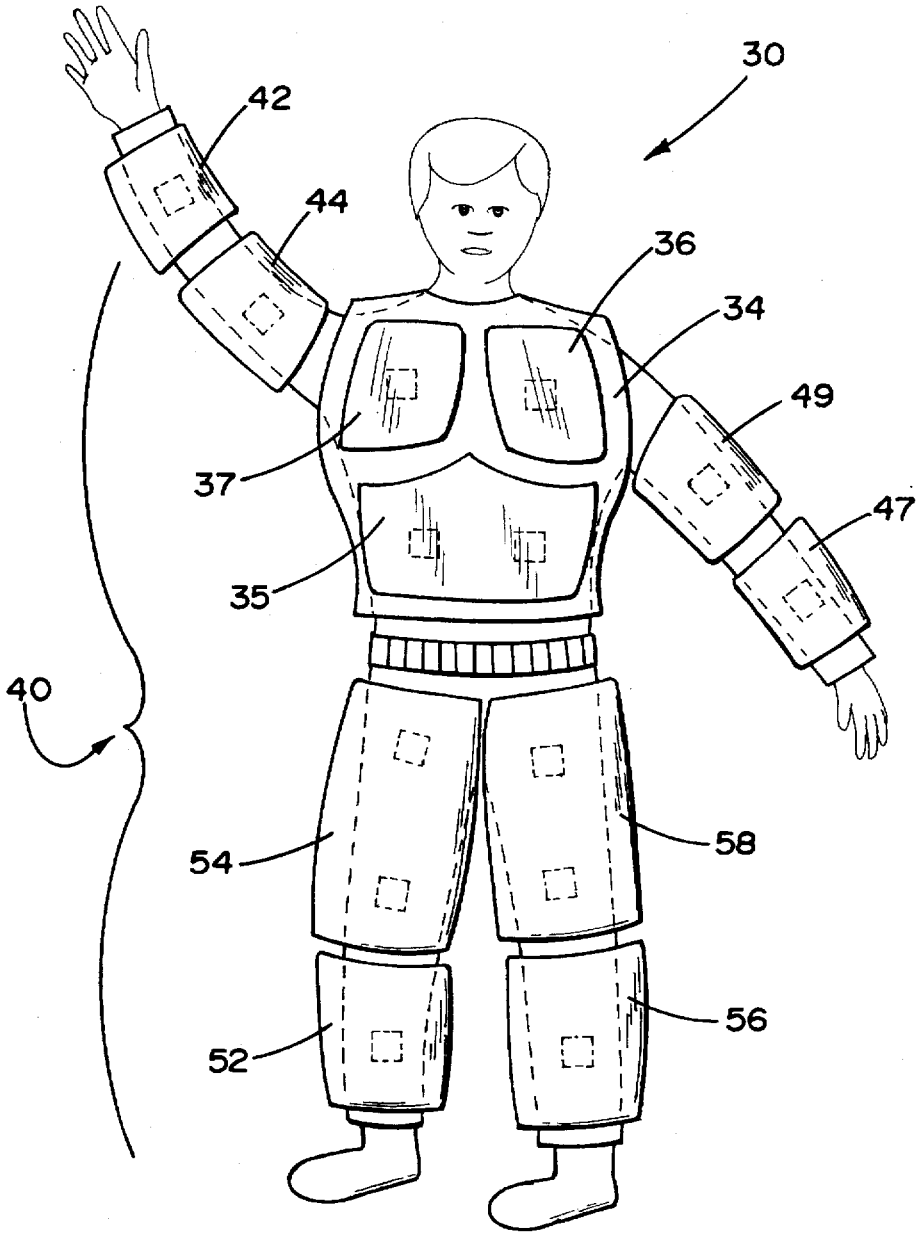
FIG. 1 is a front elevational view of an individual wearing a play costume in accordance with an embodiment of the present invention.
Figure 2:
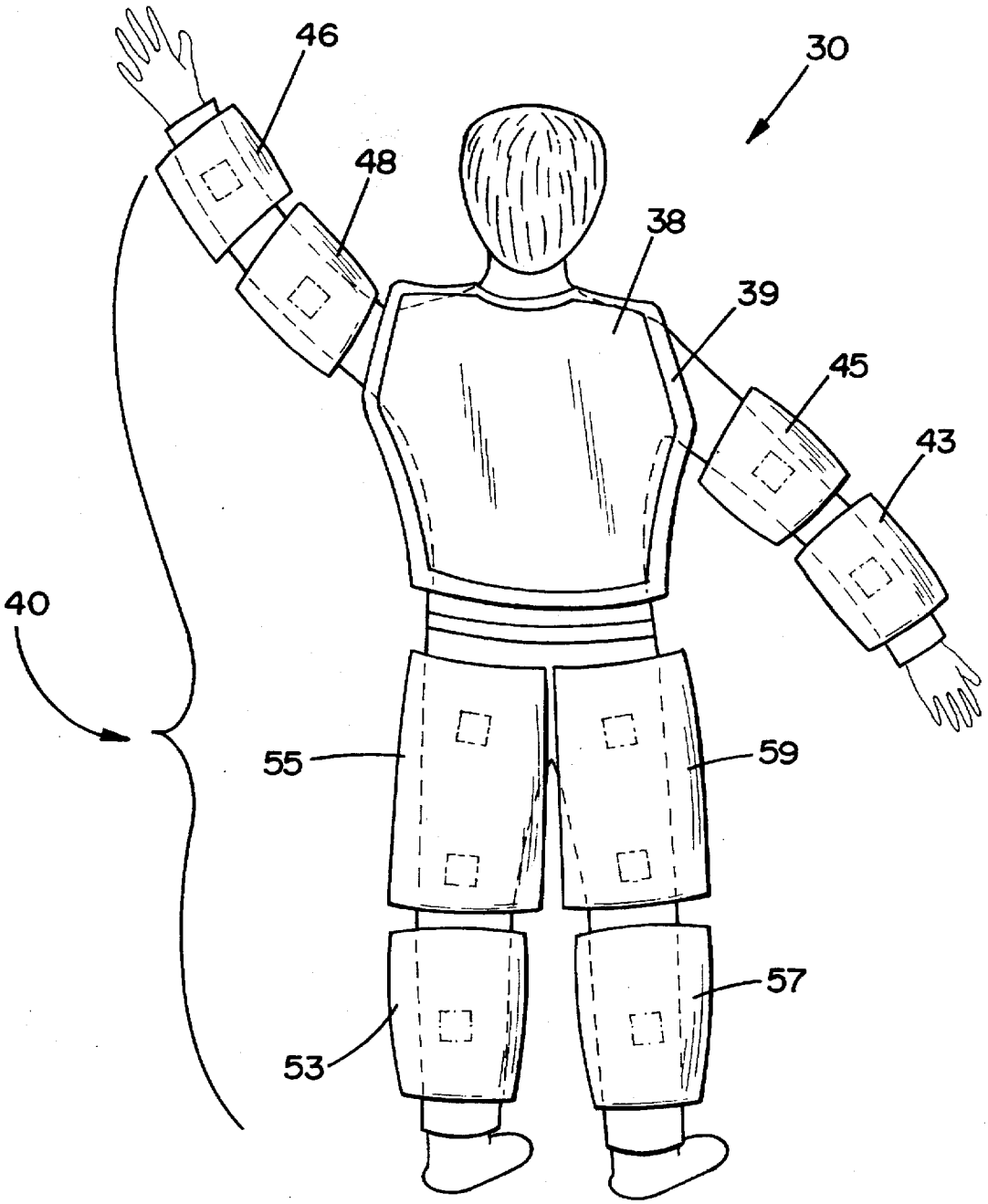
FIG. 2 is a rear elevational view of an individual wearing the play costume of FIG. 1.

In FIGS. 1 and 2, a play costume in accordance with the present invention is designated generally by reference numeral 40 and is shown worn by an individual 30. The play costume 40 is comprised of a plurality of resilient and deformable body pad pieces. In the preferred embodiment of FIGS. 1 and 2, eight arm pads are utilized. FIG. 1 shows right front forearm pad 42, right front upper arm pad 44, left rear forearm pad 47 and left rear upper arm pad 49. FIG. 2 shows right rear forearm pad 43, right rear upper arm pad 45, left front forearm pad 46 and left front upper arm pad 48.

Also preferably utilized, as shown in FIGS. 1 and 2, are eight leg pad pieces. FIG. 1 shows right front lower leg pad 52, right front upper leg pad 54, left front lower leg pad 56 and left front upper leg pad 58. FIG. 2 shows right rear lower leg pad 57, right rear upper leg pad 59, left rear lower leg pad 53, and left rear upper leg pad 55.

Each of the arm and leg pads are preferably detachably secured to one or more articles of specially constructed clothing, preferably by means of a plurality of coacting "hook" and "loop" fastening elements (e.g. VELCRO™) mounted thereon and releasably engageable with each other upon disposition of the pads onto a corresponding section of the clothing. The various pads are preferably constructed of a foam rubber material. Optionally the pad pieces may be constructed of other suitable materials, such as inflatable or fluid filled plastic or rubber materials, styrofoam or any other materials effective for forming resilient deformable pads.

Also preferably utilized are two body plates onto which can be attached four torso pads. As shown in FIG. 1, front body plate 34 has detachably secured thereto a front lower torso pad 35, a front left upper torso pad 36 and a front right upper torso pad 37. FIG. 2 shows rear body plate 39, onto which is attached rear torso pad 38, preferably sewn on or otherwise permanently affixed by means of an adhesive.

Figure 6:
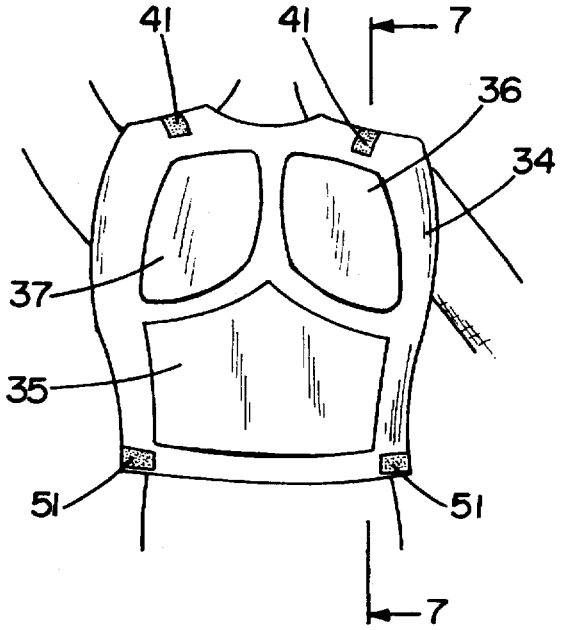
FIG. 6 is a front elevational view of a portion of an embodiment of a play costume including a chest plate, chest pads, and connecting elastic straps in accordance with the present invention.
Figure 7:
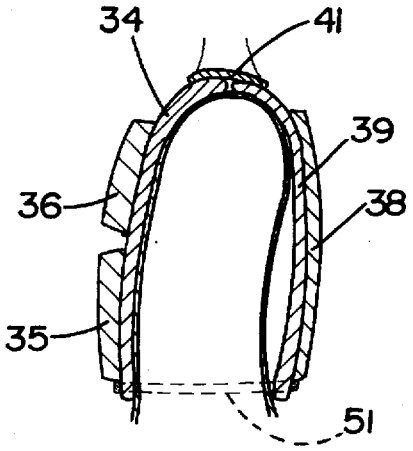
FIG. 7 is a side view in the direction of lines 7—7 of FIG. 6.

As shown in more detail in FIGS. 6 and 7, the two body plates 34 and 39 are preferably permanently attached to each other by means of a pair of over-the-shoulder elastic straps 41. Also preferably included are elastic straps 51 at the end of which are provided mating hook and loop fastening elements. The plates 34 and 39 are positioned on the wearer's body by pulling the plates over the wearer's head, and hook and loop fastening elements on the front plate 34 are then engaged with cooperating hook and loop fastening elements on the straps 51. The body plates 35 and 39 are preferably constructed of a padding material.

While the use of the two body plates 35 and 39 is preferable, the two plates may not be included in the costume and the torso pads may alternatively be directly detachably attached to either specially adapted articles of clothing or to each other.

Referring to FIG. 3, an embodiment of a play costume 40 is shown worn by a standing individual 30. The illustrated costume is intended to be representative of a "CYBORG MAN", part man and part computer. In FIG. 4, the costume wearer 30 is shown crouched down in a kneeling position and the CYBORG MAN costume 40 is now simulative of a computer system 40' including a simulated monitor 31, disk drives 32, and a keyboard 33. Other examples of transforming costumes which may similarly be constructed in accordance with the present invention include a "LIZARD MAN" (not shown) transformable from a simulated lizard when the wearer is in a standing position into a simulated bush or plant when the wearer is in a crouched and/or kneeling position; and a "ROCKET MAN" (not shown) transformable from a human-like creature into being simulative of a rocket or a missile.

Two embodiments of specially adapted clothing sets to which the various pads of the present invention are attached will now be described in detail.

Figure 5:
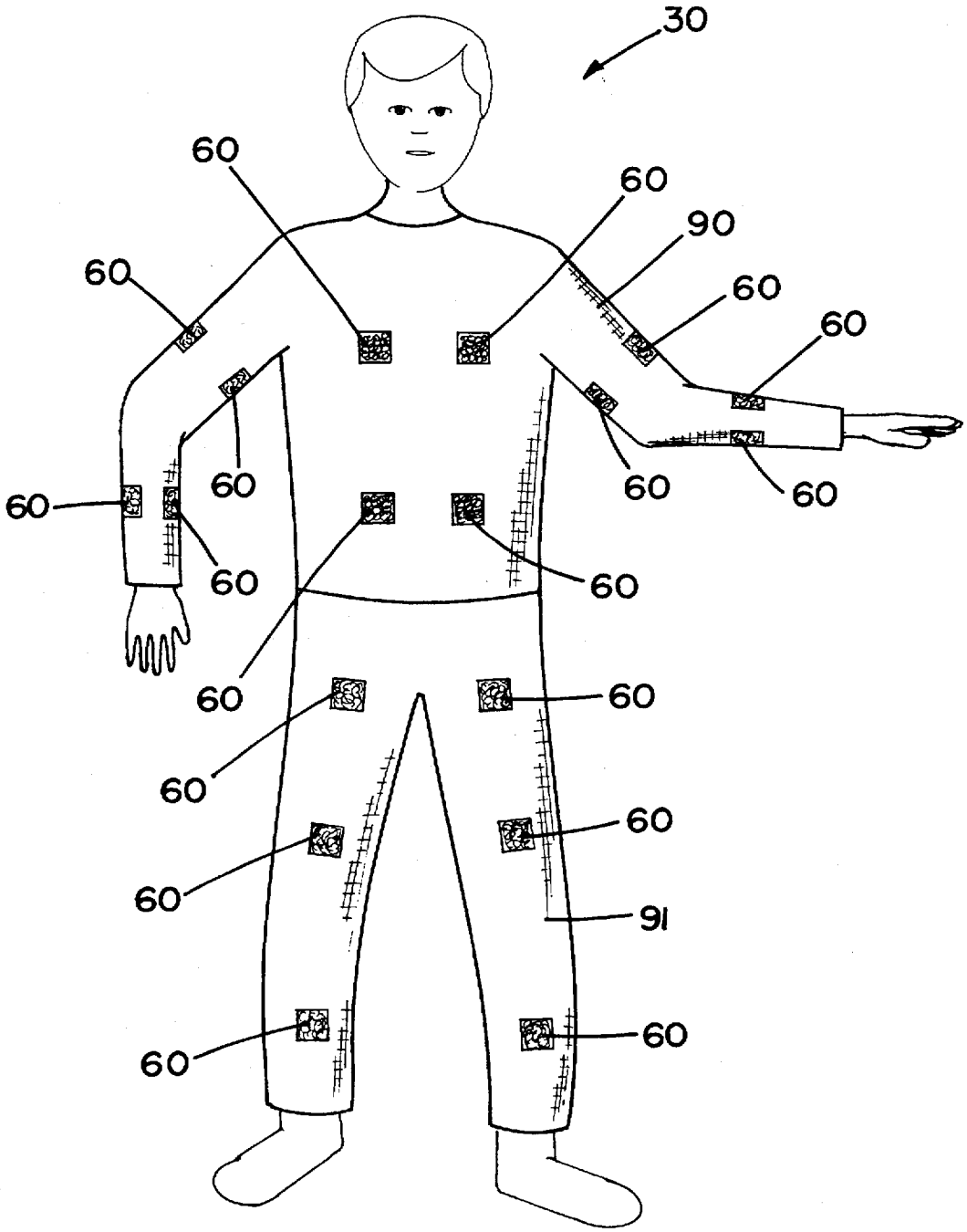
FIG. 5 is a front elevational view of an individual wearing a portion of an embodiment of a play costume in accordance with the present invention without pads attached.
Figure 8:
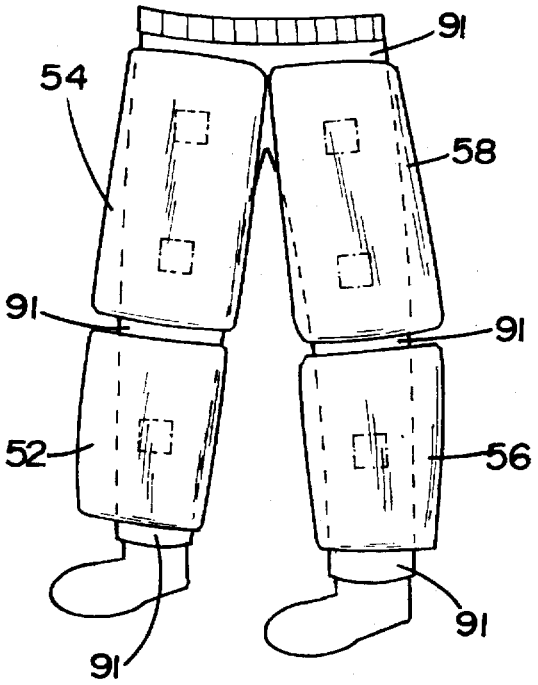
FIG. 8 is a front elevational view showing a portion of an embodiment of a play costume including leg pads and pants in accordance with the present invention.
Figure 9:
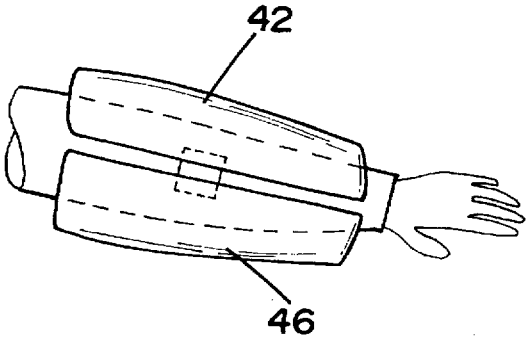
FIG. 9 is an enlarged perspective view showing a portion of an individual's arm on which is worn a pair of arm pad pieces of a play costume in accordance with the present invention.
Figure 10:
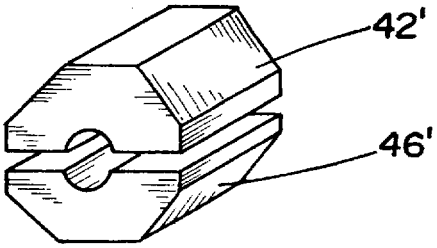
FIG. 10 is a perspective view showing an alternative embodiment of arm pads in accordance with the present invention.

The first preferred embodiment of a specially adapted clothing set is shown in FIG. 5, and comprises a costume long-sleeve shirt 90 and costume long pants 91, shown worn by an individual. Both the shirt 90 and the pants 91 have a plurality of hook and loop fastening elements 60 fixed at various locations thereof and positioned to releasably engage with corresponding mating hook and loop material fastening elements 62 fixed to the back sides of the plurality of pads described above. The pads can thus be detachably mounted to the shirt 90 and pants 91 to create a play costume in accordance with the present invention. FIG. 8 shows the inner surfaces of the front leg pads 52, 54, 56, and 58 having the hook and loop fastening materials 62 secured thereto. FIG. 9 shows the inner surfaces of the left front and rear arm pads 42 and 46 having the fastening materials attached thereto. FIG. 10 shows an alternate embodiment of arm pads 42' and 46' opposing to each other.

Figure 11:
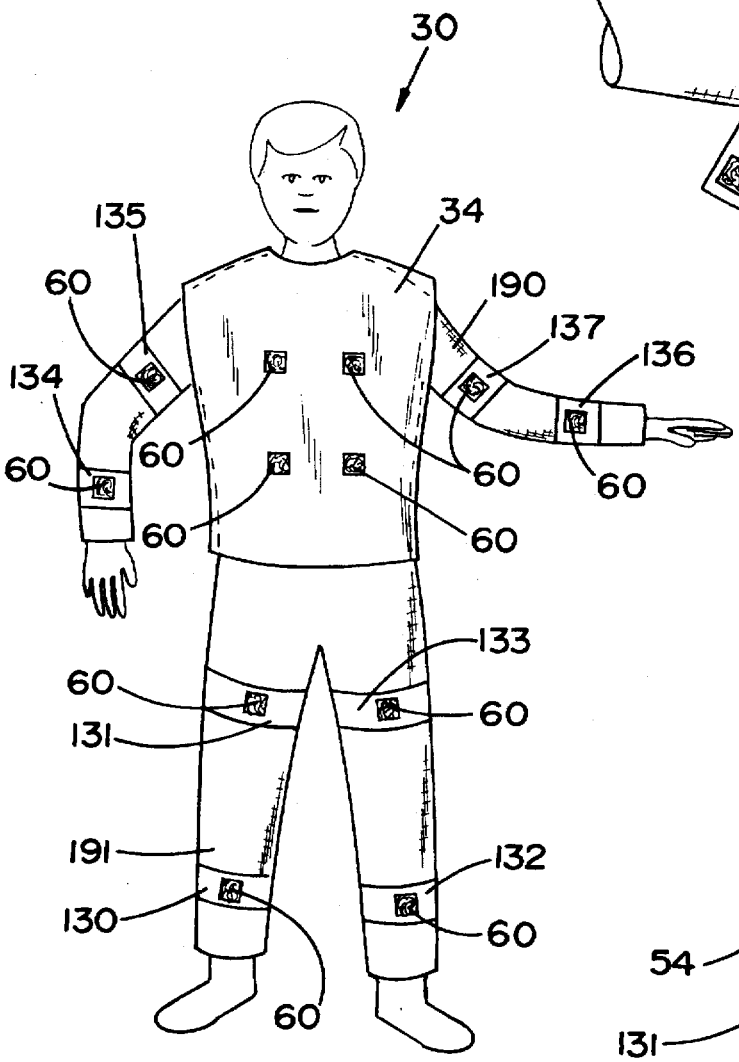
FIG. 11 is a front elevational view showing an individual wearing a play suit shirt, leg bands, and arm bands with fastening elements arranged thereon for securing the body pads in accordance with the present invention.
Figure 13:
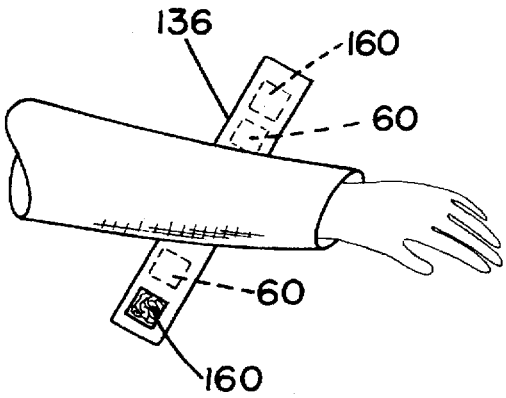
FIG. 13 is an enlarged illustrational view showing a portion of an individual's arm wearing an arm band with mating fastening elements arranged for securing the arm band to the arm.
Figure 12:
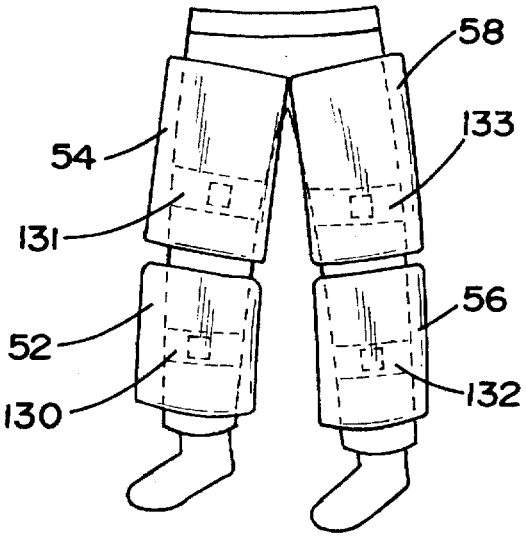
FIG. 12 is a front elevational view showing the legs of an individual wearing leg pads and leg bands in accordance with the present invention.

Referring to FIGS. 11 through 13, a second preferred embodiment of a specially adapted clothing set to which the assorted pads can be attached is shown, and comprises a plurality of bands utilized to hold the pads to the arms and legs of the individual. Each of the bands has preferably two strips of hook and loop fastening elements 60 secured thereto, one for each respective front pad and rear pad with which the mating hook and loop fastening elements 62 on the pads can engage. The bands also preferably include cooperating hook and loop fastening elements for securing the bands around the individual's arms and legs. Alternatively, elastic bands which can be pulled into position over the individual's arms and legs may be used. This embodiment of the play costume preferably comprises eight bands, including right forearm band 134, right upper arm band 135, left forearm band 136 and left upper arm band 137, as well as right lower leg band 130, right upper leg band 131, left lower leg band 132 and left upper leg band 133. Each of the bands included with the play costume are preferably constructed of an elastic material with the hook and loop fastening elements preferably sewn or glued on. The bands can be produced in a variety of lengths for use by various sized individuals. This embodiment of specially adapted clothing provides the added advantage that conventional pants and a conventional shirt can be worn underneath the bands. The chest plate 34 is worn on the body in the same manner as described with respect to FIG. 6.

FIG. 12 illustrates the inner surface of front leg pads 52, 54, 56 and 58 releasably attached to the leg bands 130, 131, 132 and 133.

FIG. 13 illustrates the manner of attaching the left forearm band 136 about the arm of the wearer. The band 136 has mating hook and loop fastening elements 160 for fastening over the wearer's arm, as well as front and rear hook and loop fastening elements 60 for engaging and attaching the appropriate front and rear pads.

In an alternative embodiment (not shown), a single body suit having a plurality of hook and loop fastening elements 60 attached thereto can be utilized.

In another alternative embodiment (not shown), the various arm, leg and torso pads could be worn on an individual's body by detachable attachment to each other. For example, front lower left leg pad 56 may be provided with hook and loop fastening elements 60 which cooperate with corresponding hook and loop fastening elements on rear lower left leg pad 53 to hold the two leg pads together on the wearer's body. Each of the various pads may be held onto the wearer's body in this manner.

Figure 17:
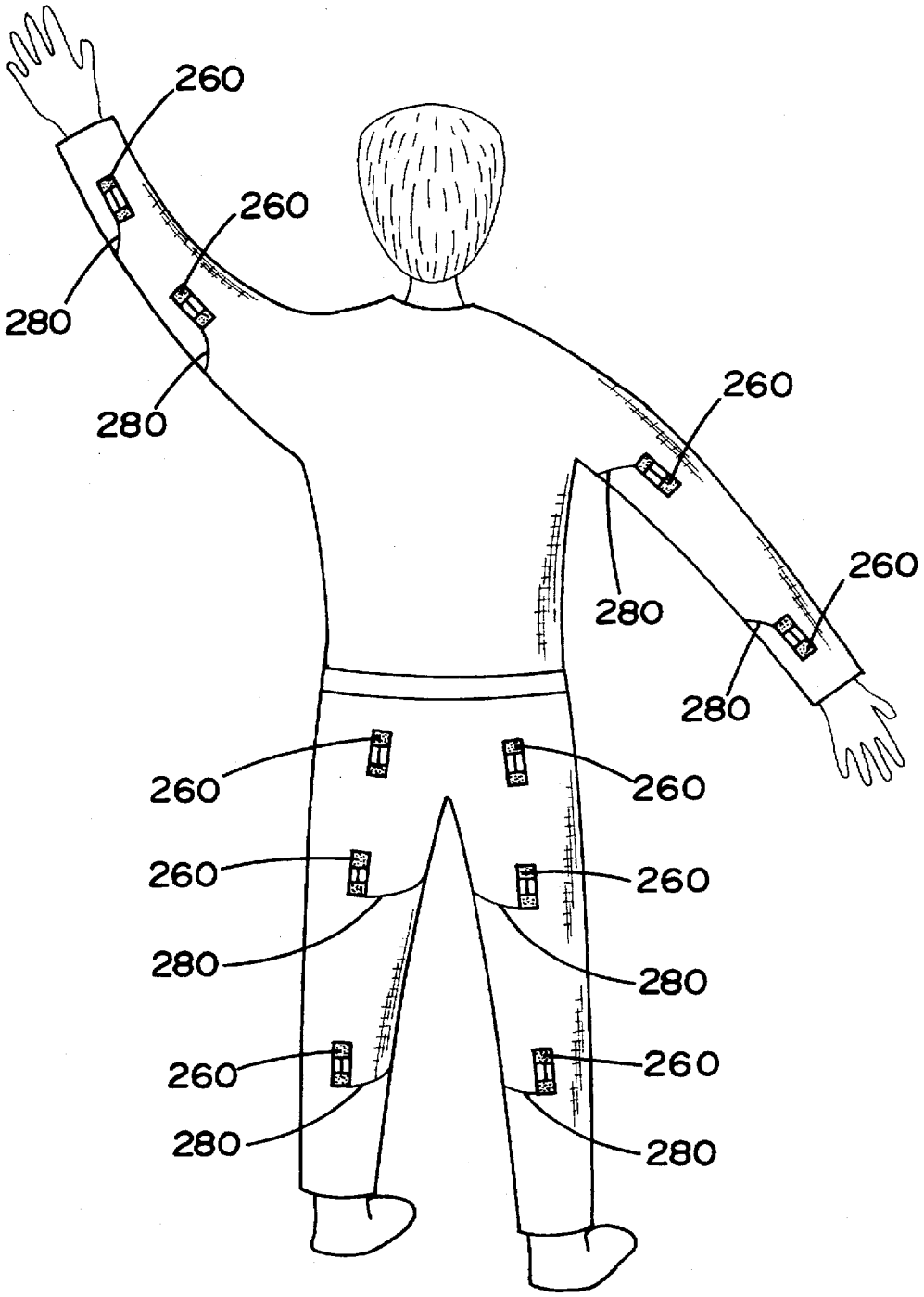
FIG. 17 is a rear elevational view of an individual wearing the play costume of FIG. 14.

Now turning to FIGS. 14 through 25, another embodiment of the present invention is shown including a sound unit featuring electrical sensors and sound producing means for sensing contact with, and/or detachment of, one or more of the pads of the play costume, and for producing audible sounds when such contact or detachment occurs. Referring to FIGS. 14 and 17, an individual is shown wearing part of another embodiment of a play suit 240. This embodiment preferably includes a shirt 290, pants 291, an electronic control module 270, wires 280, and a plurality of combination electrical sensors and hook and loop fastening element patches 260 arranged for securing the body pads to the wearer's clothes. The control module 270, shown with an on/off power switch 278, a speaker 279 and several light emitting diodes (LEDs) 277, can contain batteries for powering the system. In addition, control module 270 can include other features not shown such as a volume control, assorted status button(s), game reset button, a harness jack and a cartridge slot. The LEDs on the control module can be utilized to signal that the system is on and operating properly.

Figure 18:
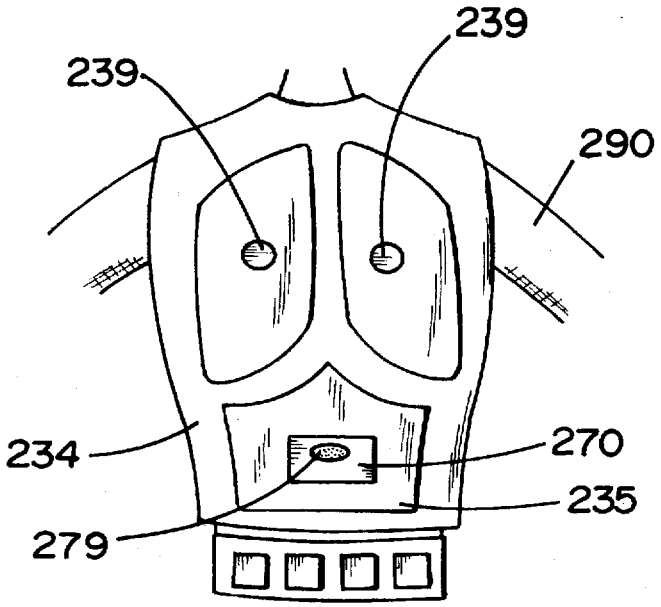
FIG. 18 is a front elevational view of a portion of the play costume of FIG. 14 including a shirt, front torso body shield, front torso body pads and a electronic control module.
Figure 19:
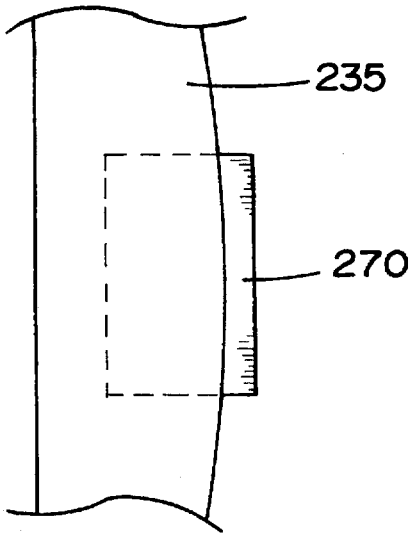
FIG. 19 is an enlarged partial side view showing a front lower torso body pad and an electronic control module in accordance with the present invention.

Infrared sensors 239, shown in FIG. 18, can be fixed to the costume. When the sensors 239 are hit by an infrared signal generated by an infrared source, an audible signal is generated by the sound system.

In addition to the LEDs 277 on the control module, another plurality of light sources, such as small red LEDs, can be fastened at assorted locations on the pads and/or on the clothing holding the pads. The LEDs can be programmed to flash when the IR sensors are hit by an IR source, or alternatively to illuminate to signify a target, the LED shutting off when the target is hit by an IR source. Various games can be played with a count of hits; being kept by the belt mounted control unit.

FIG. 15 shows in more detail the preferred positioning of electrical wires 280 along and within a seam 241 of the suit 240.

FIG. 16 shows in more detail one embodiment of the electrical sensor units 260 for mounting onto a clothing piece such as the shirt 290 or pants 291 of FIG. 14. The sensor units 260 preferably include two regions of hook and loop fastening elements 261, sensor plates 271 and 272 and a pair of rivets 275 for holding the sensor plates 271 and 272 in place on a backing material.

FIG. 20 is an enlarged view showing an electrical sensor and a hook and loop fastening element in accordance with the present invention. At each of the hook and loop fastening element attachment areas are disposed electrical sensor pairs 260. The electrical sensors 260 are preferably constructed from hard plastic material molded into a desired shape such as the shape shown in FIGS. 20 and 21. Electrical contact plates 271 and 272 are also shown in FIG. 21. The contact plates 271 and 272 are preferably secured by means of metal rivets 275 as shown in the embodiment of FIG. 16. The electrical wires 280 for each sensor attach at the same location.

Figure 23:
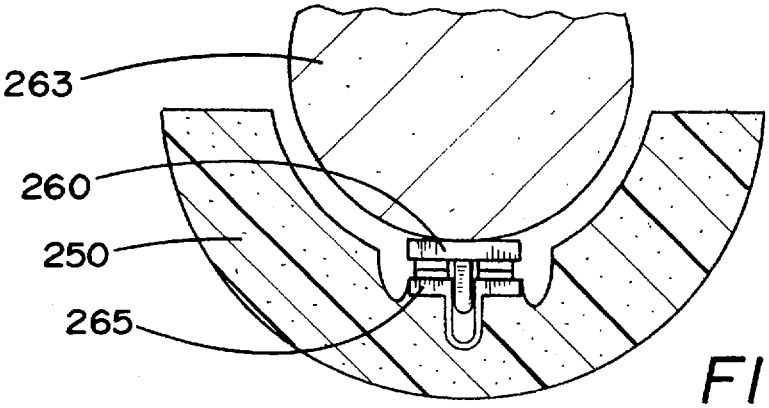
FIG. 23 is an enlarged cross-sectional view of an individual's arm to which is attached an electrical sensor and an arm pad in accordance with the present invention.
Figure 24:
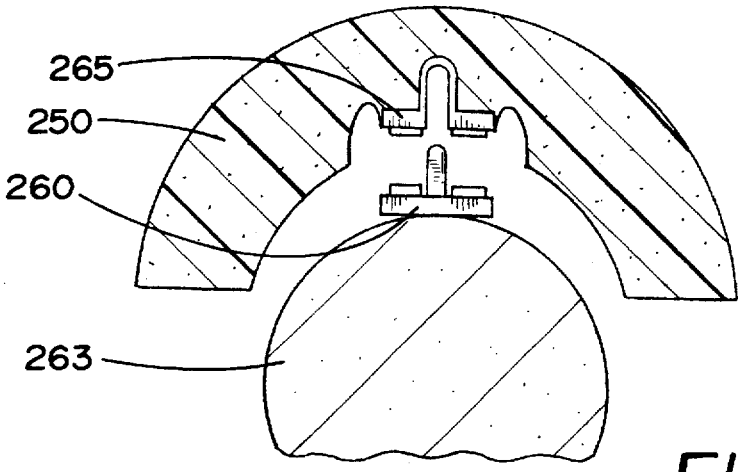
FIG. 24 is an enlarged cross-sectional view of an individual's arm to which is attached an electrical sensor and a detached arm pad in accordance with the present invention.
Figure 25:
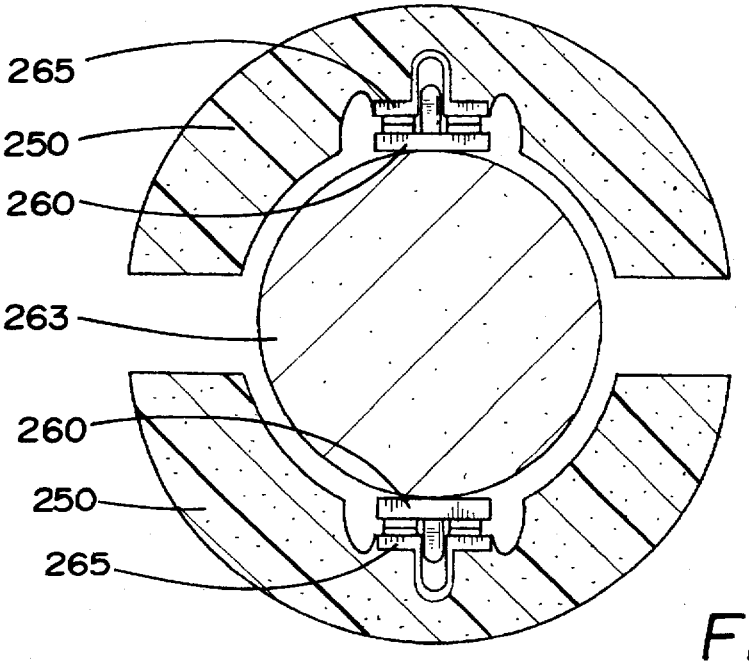
FIG. 25 is an enlarged cross-sectional view showing worn on an individual's arm, two electrical sensor pairs, and attached arm pads in accordance with the present invention.

Some or all of the pads mountable on the clothing have electrical sensors 265 as shown in FIG. 22. FIGS. 23 through 25 show worn on an individual's arm 263 the mounting of pads 250 having pad electrical sensors 265 to clothing electrical sensors 260. In FIG. 23, the electrical sensor 265 is shown attached to an arm pad 250 and its associated sensor 260. In FIG. 24 the electrical sensor 260 is shown separated from the arm pad 250 and its associated sensor 265.

FIG. 25 shows worn on an individual's arm 263 two electrical sensor sets 260 attached to two arm pads 250 and their associated sensors 265, forming a matching pair of arm pads.

As shown in FIG. 18, the electronic control module 270 fits within the lower torso pad of the costume secured to the front of the torso body shield. A battery compartment (not shown) is contained within the control module 270 for holding batteries to power the sound unit. A speaker 279 or other audible signal generating means is also preferably mounted within the control module 270. Other controls including volume, LEDs, status and game reset buttons, a harness jack and a cartridge slot may also be included in the control module 270. Alternatively, the electronic control module 270 may be mounted on a belt or other part of the costume.

Partially shown in FIG. 18 is the upper torso of a person wearing the play costume having an integral sound system. The front torso body plate 234 is positioned over the shirt 290. A front lower torso body pad 235 is preferably permanently fixed to the body plate 234 and is specially constructed to protectively contain the control module 270, as can be seen in detail in FIG. 19.

In the arm and leg band embodiment, the sensors 260 can be secured to the arm and leg bands and the chest plate. In the shirt and pants embodiment, the sensors can be secured directly to the shirt and to the pants.

Figure 26:
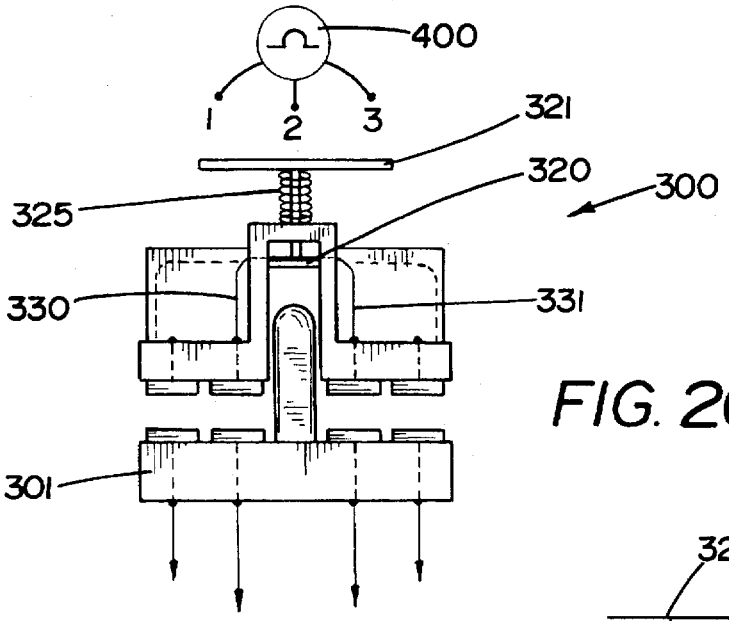
FIG. 26 is a side view of an embodiment of a sound effects triggering device which can be used in accordance with the present invention, shown separated from an apparel mounted base.

FIGS. 26 through 37 show aspects of another embodiment of a sound signal activating system which can be used as a portion of the present invention. FIG. 26 shows the system separated from an apparel mounted base. Three different means for activating the sound generating means are provided: an infrared activation system, a detaching pad switch system, and a plunger switch system. An infrared source 400 can be provided, preferably by triggering an infrared signal generating weapon while aiming the weapon at infrared sensors located on top of one or more of the pads. An activator 300 is contained within the same pads. An apparel mounted base 301 is located on the outside of at least one of the body worn clothing. Mating hook and loop elements (not shown) surrounds the outside edges of both the apparatus 300 on the pad and the base 301 on the clothing. The hook and loop elements are sufficiently strong to hold the pad onto the clothing.

A number of contact pads are provided on both the base 301 and the pad contained activator 300. In the top view of FIG. 29 the apparel mounted base 301 is shown having three infrared contact pads 302, 303, 304, two illumination system contact pads 305 and 307 and a dummy pad 306 for possible later use. A power supply pad 310 is used for electrical connection to power the system through electrical path 310' to the power supply (not shown) and to the plunger switch 320. A plunger switch pad 309 is provided for connection to the plunger switch through electrical path 309'.

Figure 27:
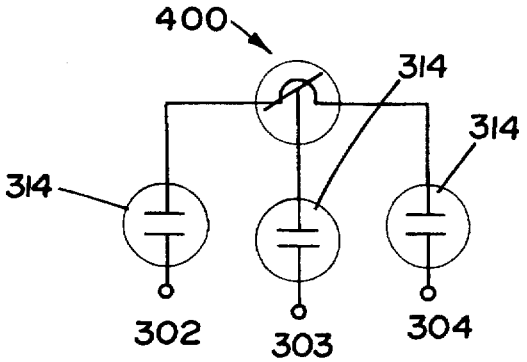
FIG. 27 is a circuit diagram for an infrared sound trigger system which may be used in the embodiment of FIG. 26.
Figure 29:
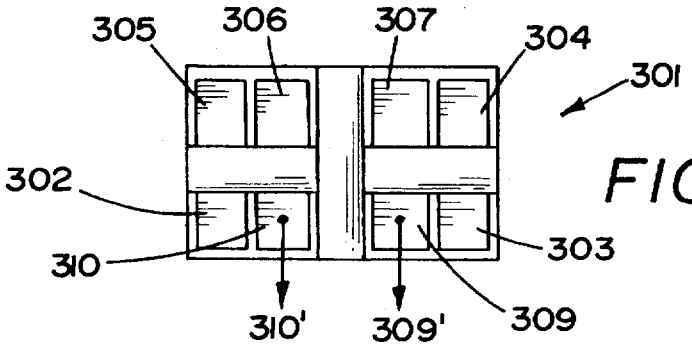
FIG. 29 is a top perspective view of the apparel mounted base section portion of the embodiment of FIG. 26.

FIG. 27 is a circuit diagram for the infrared sound trigger system of FIG. 26.

The sound system is activated if the pad containing the activator 300 is detached from the base 301 on the clothing, causing the respective contacts to disassociate. Also, the sound system is activated if physical contact is made with the pad, forcing the plunger switch inward against the bias of the spring, which breaks the circuit with wiring 330 and 331, triggering the sound system.

The plunger switch 320 including plunger handle 321 is biased away from the unit 300 by a spring 325.

Figure 28:
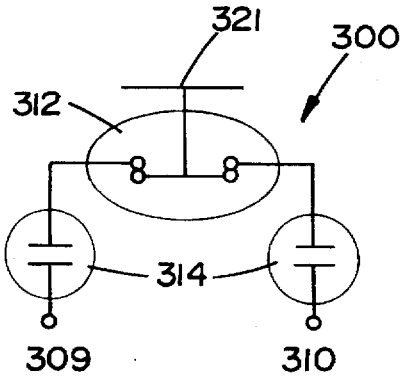
FIG. 28 is a circuit diagram for a plunger switch for activating a sound system which can be used in the embodiment of FIG. 26.
Figure 33:
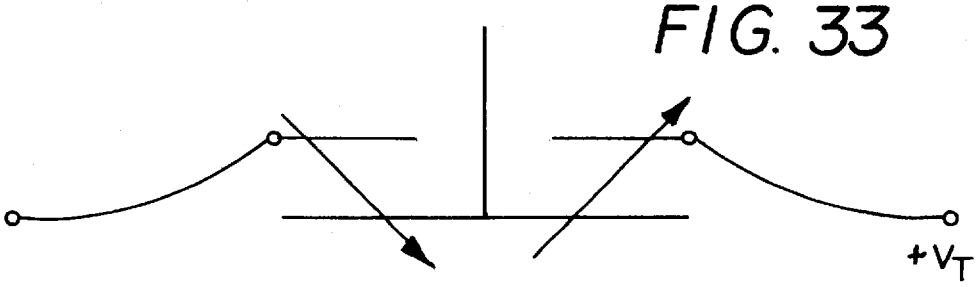
FIG. 33 is a circuit diagram for the plunger contact switch of FIG. 32.

FIGS. 28 and 33 show a circuit diagram for a plunger contact switch 312 for activating the sound system. When the pads, represented by numerals 314 are contacted, a circuit is created to activate the sound system.

Figure 30:
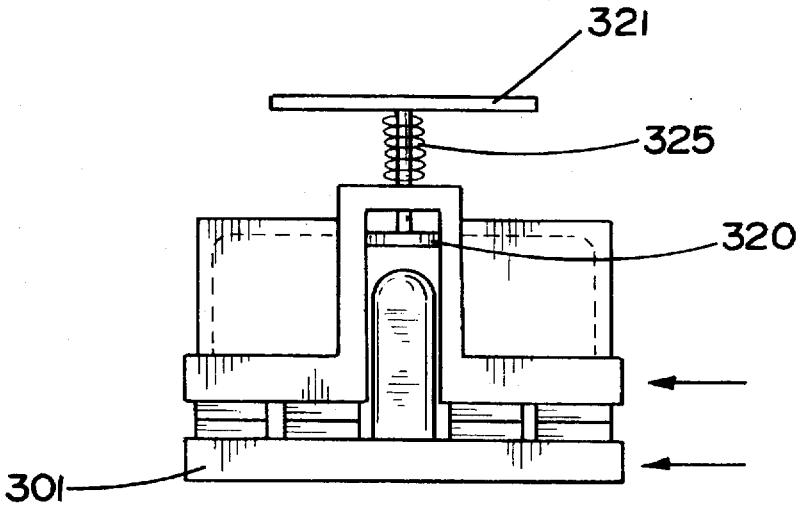
FIG. 30 is a side elevational view of the sound effects triggering device of FIG. 26 shown temporarily attached to the apparel mounted base.

FIG. 30 is a side view of the FIG. 26 sound effects triggering device shown temporarily attached to the apparel mounted base.

Figure 31:
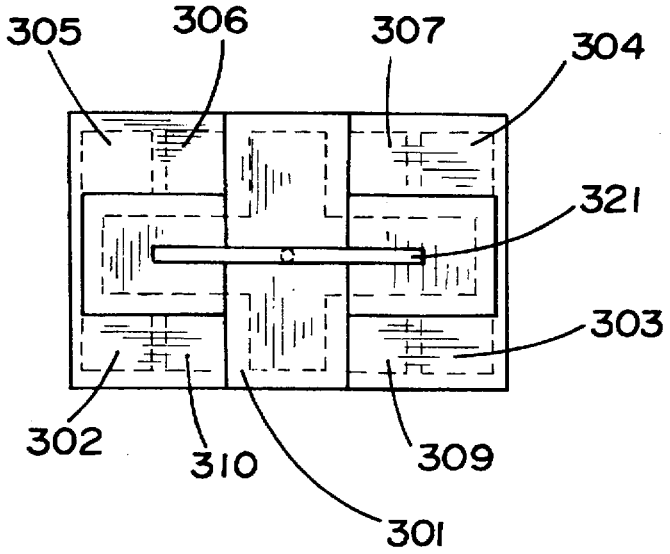
FIG. 31 is a top plan view of the sound effects triggering device of FIG. 26 shown temporarily attached to the apparel mounted base.

FIG. 31 is a top perspective view of the sound effects triggering device of FIG. 26 shown temporarily attached to the apparel mounted base.

Figure 32:
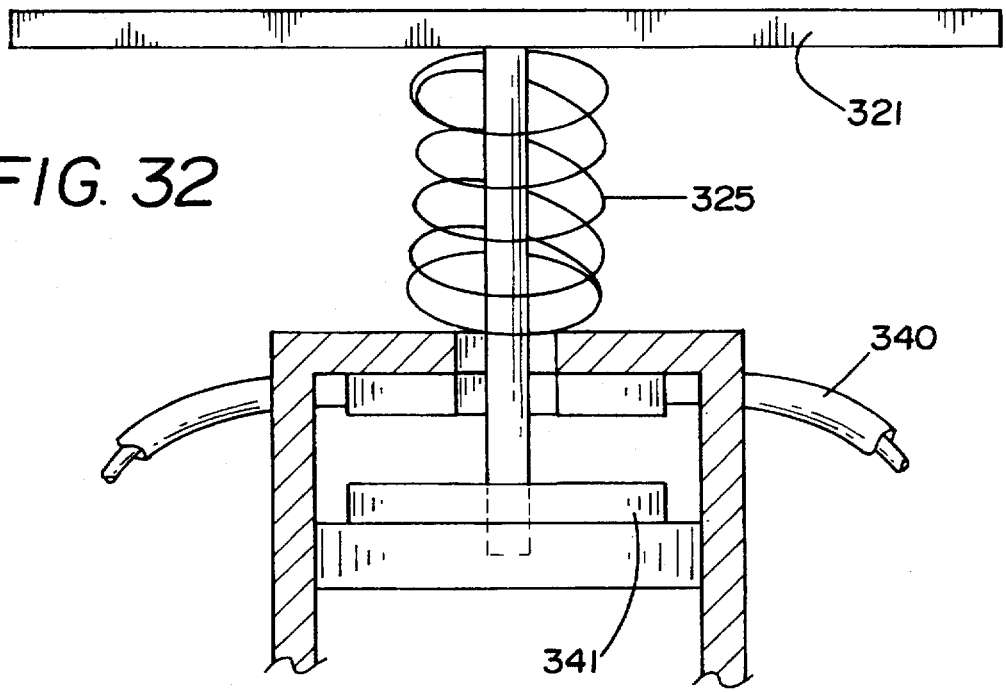
FIG. 32 is a side view of a portion of an embodiment of a plunger switch sound effects triggering device which can be used with the embodiment of FIG. 26.
Figure 35:
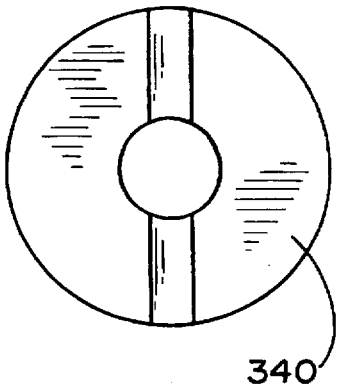
FIG. 35 is a top view of a second electrical contact disk for use with the plunger contact switch of FIG. 32.
Figure 34:
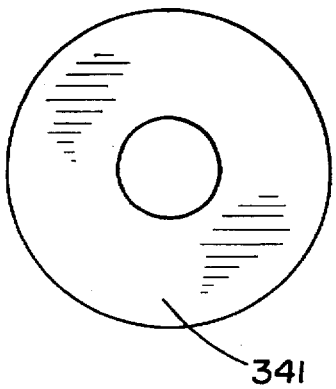
FIG. 34 is a top view of a first electrical contact disk for use with the plunger contact switch of FIG. 32.

FIG. 32 is a side view of a portion of a slightly different plunger switch sound effects triggering device which can be used with the embodiment of FIG. 26. FIG. 34 shows a top view of a first electrical contact disk 341 for use with the plunger contact switch of FIG. 32 and FIG. 35 shows a top view of a second electrical contact disk 340 for use with the plunger contact switch of FIG. 32. Normally, the spring 325 will urge the plunger 321 and its associated contact disk 341 into contact with contact disk 340. However, if the plunger 321 is forced inward, contact disk 340 and contact disk 341 are disassociated, activating the sound generation system.

Figure 36:
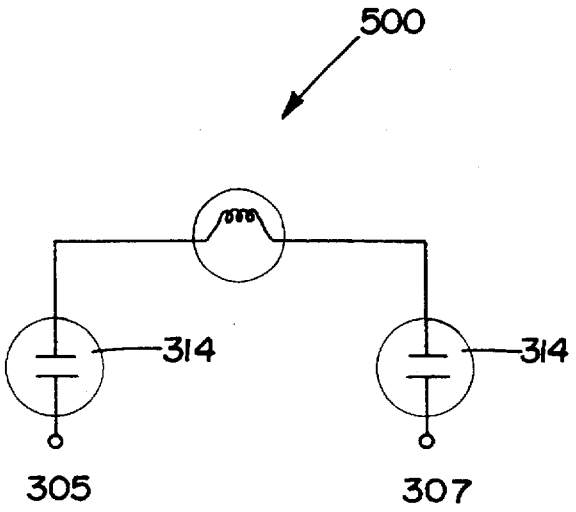
FIG. 36 is a circuit diagram for an illumination system.
Figure 37:
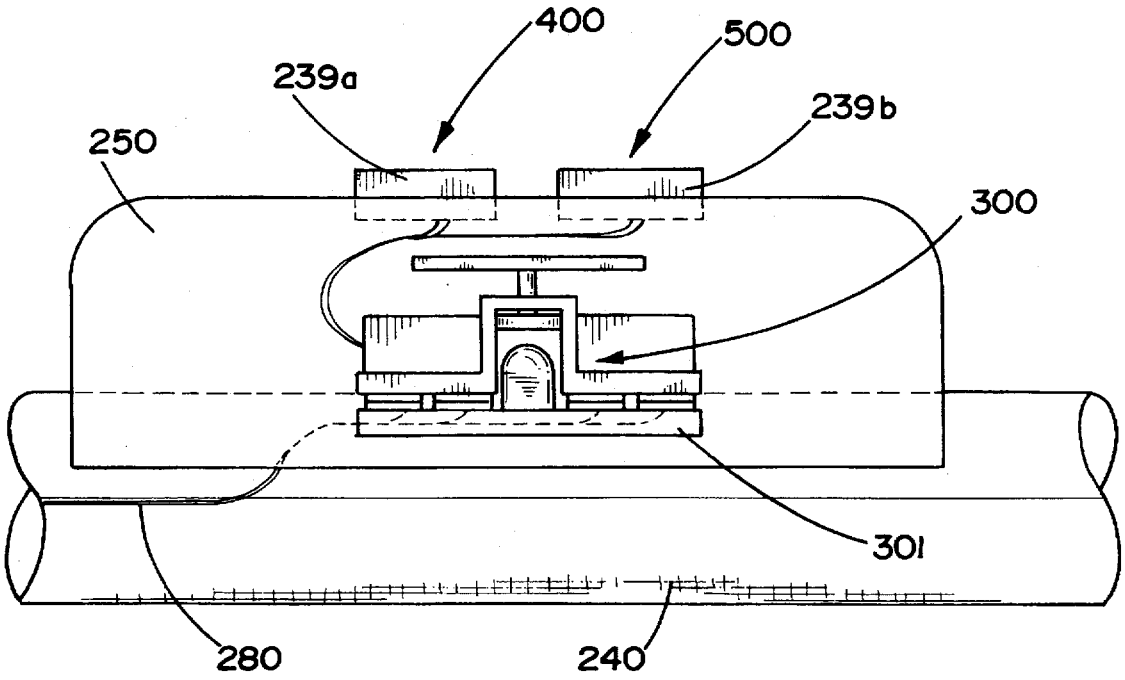
FIG. 37 is a side view in cross-section of an embodiment of a sound and illumination effects triggering device which can be used in accordance with the present invention.

An illumination effects system for lighting up one or more light sources, such as LEDs, is added in the FIG. 37 embodiment. Sound system infrared sensors **239*a* and illumination system infrared sensors 239*b* are located at the top of the pad 250. An infrared signal 400 communicating with the sound system infrared sensors 239*a* activates the sound system. A second infrared signal 500 communicating with the illumination infrared sensor 239*b* activates the light system. The circuit diagram for the illumination effects system 500 is shown in FIG. 36**.

Numerous additional optional features, accessories and other peripherals can be incorporated into the play costume of the present invention or produced separately for use with the play costume. Some of such optional peripherals are described below.

Removable cartridges (not shown) can be utilized with the interactive sound system and can include sound cartridges with a contained program. The sound system can be a central electronic computer brain of the play costume construction. Each type of signal can be programmed to cause the sound system to generate a different combination of sounds.

The sound unit can be programmed to announce various play costume status condition statements including simulated battle damage amounts in percentages, energy levels, life support systems, shield systems, shield conditions, recovery times, weapons inventory, etc. Each of these announcements can be activated directly from the sound unit push button display or by voice activated commands. In addition each time the sound system is turned on, it generates and broadcasts a boot-up system sound effect combination.

Each play costume and weapon can be packaged and sold separately with its own designated sound cartridge. This sound cartridge can be unique to that system or weapon and can provide a completely different set of computer sound effects. The cartridges can be made interchangeable, and various sounds can be produced including such sounds as simulated cannons, space ship and space weapon sounds, phasers, and continuous sounds like Gatling guns.

The sound unit can include a programmable computer software package (not shown) enabling a user to create and download self-created sound effects for various functions. The software can be programmed to graphically display simulated slide switches controllable by a mouse or joystick or buttons on the display. Simply click on the sound effect to be changed, adjust the sound control slide switches and test the new sound.

The sound unit can contain a volume control, multiple push buttons for individual status announcements, a wire harness connector, remote sensor connector, speaker, sound cartridge slot, and battery compartment.

In an alternative embodiment of the invention, integral sound units within the play costume can be remotely activated by "opponents" also wearing play costumes of the present invention. An infrared remote sensor system (not shown) similar to those used for TV remote controls can be provided, each button on the remote control programmed to produce a different sound effect on an opponent's sound unit. When a user aims and hits the opponent's costume remote sensors, the opponent's sound unit is activated. The type of button pushed, and the duration of infrared contact with the opponent's remote sensor determines the type, duration and level of sound produced by the opponent's sound unit. Each button can have a designated simulative destructive power and the duration of direct hits to the sensors determines how much damage is created and which sound effects are produced by the opponent's sound unit. The program card associated with the remote sensor can track direct hits and announce the amount of sustained body damage. If enough body damage is sustained over a specific period of time, the sound unit can be programmed to sound simulative of a self-destruction noise. If enough time has passed between hits, the user can repair itself and gain power.

The infrared remote sensors can be located on one to all of the detachable body pads and can be wired into the body pad wire harness.

Infrared transmitters can be constructed in a variety of shapes and sizes to resemble various weapons or tools. The transmitters can be constructed to plug into an existing arm pad electrical connector provided with a separate plug for the transmitter unit. Each transmitter can have a unique set of functions related to its use. Each simulated beast, monster or human costume can have his or her or "its" own unique and special powers and weapons.

Detachable weapons, such as weapon 50 shown in FIG. 3, can be sold separately and constructed to replace an individual body pad. The weapon 50 may be used as part of a sound effects producing system with the inclusion of built-in infrared transmitters enabling the weapon 50 to activate an opponent's sound unit. The weapon 50 is preferably constructed of foam pad material and is preferably attachable to the arm or leg with hook and loop fastening element patch strips replacing one or more of the body pads.

In addition to weapon 50, eyeglasses or other eye wear can be added to the costume. The optional weapon 50 and eyeglasses can be replaced by other head or body worn or mounted gear. FIG. 3 shows an individual wearing a simulative eye lens 170 comprised of a battery operated eye piece where the eye piece moves back and forth.

A mouth piece 171, as shown in FIG. 3, with a voice activated command unit can be provided for activation of the sound unit status comments.

Spot lights (not shown) comprised of head mounted flashlights can also be included, as can be real or simulated night vision devices (not shown).

Carrying bags can be included to keep the play costume, weapons, sound system, and head gear together, carried, and stored for future use without loss.

A belt can also be utilized with the play costume. The belt is preferably constructed from an adjustable elastic band which fits around the user's waist and is secured by hook and loop fastening elements. In addition to or instead of the belt, a waist band may be used with the play costume of the present invention including hook and loop fastening element pads sewn to various places along the band, onto which optional accessories can be attached.

Additional pads along with shirts and pants or bands in various color patterns and characters can be included or provided separately to replace the original shirts, pants bands and pads.

The material used for the detachable pads of the present invention is preferably a foam rubber or like material molded into a desired shape and covered by different paint patterns representative of different characters. The foam rubber material preferably is of the type commonly used in seat cushions, which is readily available from various distributors of foam products, such as the Coastline Foam Company of Oxnard, Calif. The foam rubber material is molded into a specific shape on the outside of the pad creating a desired pattern, while the inside of the pad is molded to fit snugly and comfortably on the wearer. The torso pieces are preferably molded with a pattern on the outside and molded flat on the inside.

The terms hook and loop fastening elements as used in this specification should be understood to also mean "hook" or "loop" fastening elements. In most cases one piece, for example an article of clothing, will have attached one or more "loop" material fastening elements while the piece to be releasably engageable therewith, for example a pad, will have one or more of the opposite "hook" material fastening elements. Different selected pieces of the costume of the present invention may have "hook" elements and other pieces have "loop" elements, so long as pieces to be engaged with each other have opposite types of elements.

All of the hook and loop fastening elements utilized in the present invention are preferably permanently fixed to the body worn apparel, preferably by sewing or alternatively by means of an adhesive such as glue. The mating hook and loop fastening elements are permanently fixed to the pads using similar affixing means. The location of the hook and loop fastening elements may be varied, so long as patches of material on the pads and mating patches of material on the body worn articles are able to attach to each other. Preferably, the rear torso pad 38 does not detach from the back base plate 111, but is instead glued or otherwise permanently affixed to the base plate 111.

Using the play costume of the present invention is very easy. If the pants 91 and shirt 90 embodiment of FIG. 5 is used, first the pants 91 and the shirt 90 are put on in the usual manner. The chest plates 34 and 39 are then optionally pulled on over the wearer's head and shirt. Next, the various pads are attached by positioning them such that the pad hook and loop fastening elements contacts the mating hook and loop fastening elements located at the intended locations on the costume. Some of the pads can be replaced by one or more of the simulated weapons if desired. The wearers are now able to playfully attempt to knock one another's pads off. If the sound system is used, as the pads are contacted and/or detached, various entertaining sounds are produced.

When using the embodiment of the present invention utilizing arm and leg bands (FIGS. 11–13), each of the various bands is placed in its intended position on the individual's body. Again the chest plates are put on by pulling them over the wearer's head. As in the above described shirt and pants embodiment, the various pads are attached by means of the mating hook and loop fastening elements located at the intended positions on the costume, and one or more of the pads can be replaced by one or more of the simulated weapons if desired. The costume wearers are now able to playfully attempt to knock each others pads off. If the sound system is used, as the pads are contacted and/or detached, various entertaining sounds are produced.

The costume of the present invention can be constructed in both human and non-human, futuristic robot simulative play versions. The costume can be constructed using readily available, easily manufactured and inexpensive materials and can be constructed such that it is comfortably worn and does not limit the wearer's freedom of movement or physical capabilities or activity.

While the above description of the present invention play costume is illustrated for wear by a child, costumes can be made in sizes for wear by others including adults and teenagers.

The costume suit can be constructed to simulate various different popular cartoon and video game characters. As explained above, the suit may also be constructed to simulate various transforming characters such as a "ROCKET MAN", a "LIZARD MAN", or a "CYBORG MAN".

The foregoing description of the preferred embodiments of the present invention has been presented to illustrate the principles of the invention and not to limit the invention to the particular embodiments illustrated. It is intended that the scope of the invention be defined by all of the embodiments encompassed within the following claims, and their equivalents.

What is claimed is:

1. A costume suitable for wear on the body of a person comprising:

a plurality of pads, each having a front side covered by color patterns representative of a character and a back side, a first hook and loop fastening element being fixed to said back side of each of said pads;

a clothing set for wear on the body of the person having arm and leg sections to which said pads can be attached over the arms and legs of the person including at least one body worn piece, each body worn piece having a body contacting inner side and an outer side, and a plurality of second hook and loop fastening elements affixed to said outer side, at least one of said elements being positioned on each arm and at least one of said elements being positioned on each leg of said clothing set, each said first hook and loop fastening element on said plurality of pads being temporarily attachable to a respective said second hook and loop fastening element on each said body worn piece, at least some of said pads capable of being detached from said body worn piece by the force of a playful impact against said pads during a mock fight; and a torso pad having an outside pattern.

2. The costume of claim 1 wherein said costume is constructed to change such that, when said pads are attached to the arms and the legs of the person, the person wearing the costume changes appearance from being simulative of a first character when the person is in a standing upright position, to being simulative of a second character when the person is in a crouched position.

3. The costume of claim 1 wherein said at least one body worn piece comprises a long sleeve shirt and a pair of pants.

4. The costume of claim 1 wherein said at least one body worn piece comprises a plurality of arm bands and a plurality of leg bands.

5. The costume of claim 1 wherein said at least one body worn piece comprises a body suit.

6. The costume of claim 5 wherein said costume is manufactured such that a person wearing the costume can change appearance to have the visual appearance of a first character having a set of pads covered by color patterns simulative of said first character and of a second character having a set of pads covered by color patterns simulative of said second character, said set of pads of said first character being interchangeable with said set of pads from said second character.

7. The costume of claim 1 further comprising a head mounted piece including a battery operated eye piece.

8. A costume suitable for wear on the body of a person comprising:

a plurality of pads, each having a front side and a back side, a first hook and loop fastening element being fixed to said back side of each of said pads;

at least one body worn piece, each body worn piece having a body contacting inner side and an outer side, and a second hook and loop fastening element affixed to said outer side, each said first hook and loop fastening element on said plurality of pads being temporarily attachable to a respective said second hook and loop fastening element on each said body worn piece; and an integral means for producing sound effects including a means for generating audible signals.

9. The costume of claim 8 wherein said integral means for producing sound effects is comprised of first electrical contacts located on at least one of said plurality of pads and second electrical contacts located on at least one of said at least one body worn piece, such that when said at least one of said plurality of pads is detached from a said respective said second hook and loop fastening element on said at least one body worn piece, an audible signal is generated by said signal generating means.

10. The costume of claim 8 wherein said sound effects producing means is comprised of a plunger contact defined by at least one of said pads and a fixed contact defined by said at least one body worn piece, such that when said at least one of said pads is compressed, said plunger contacts said fixed contact and an audible signal is generated by said signal generating means.

11. The costume of claim 9 wherein said integral means for producing sound effects further comprises a control module containing means for making various sound effects.

12. The costume of claim 8 wherein said pads are constructed of a foam rubber material.

13. The costume of claim 8 wherein said pads are constructed of an inflatable material.

14. The costume of claim 8 wherein said pads are constructed of a styrofoam material.

15. A costume kit comprising:

a plurality of pads, each having a front side covered by color patterns representative of a character and a back side, a first fastening element being affixed to said back side of each of said pads;

a clothing set for wear on the body of the person having arm and leg sections to which said pads can be attached over the arms and legs of the person including at least one body worn piece, each body worn piece having a body contacting inner side and an outer side, and a plurality of second fastening elements being affixed to said outer side, at least one of said elements being positioned on each arm and at least one of said elements being positioned on each leg of said clothing set;

said pads being temporarily mountable by engagement of said first fastening elements with said second fastening elements onto said at least one body supported piece;

at least some of said pads capable of being detached from said body worn piece by the force of a playful impact against said pads during a mock fight; and a torso pad having an outside pattern.

16. The costume kit of claim 15 further comprising:

a decorative belt;

a carrying bag; and at least one simulated weapon including a third fastening element on a portion thereof for temporarily attaching to said pads.

17. The costume kit of claim 16 wherein said at least one simulated weapon is comprised of a padded material and an infrared signal generating means, and said pads include infrared means for sensing infrared signals sent by at least one said simulated weapon.

18. The costume kit of claim 17 wherein said pads further comprise means for producing a signal upon sensing of an infrared signal generated by said at least one simulated weapon, said signal being an audio or visual communication.

19. A costume suitable for wear on the body of a person comprising:

a plurality of pads each of which has a front side and a back side, and a hook and loop fastening element being affixed to said back side of each of said pads;

at least one body worn piece, each piece having a body contacting inner side and an outer side, and a hook and loop fastening element affixed to said outer side thereof, said hook and loop fastening element on said plurality of pads being adapted to mate with a hook and loop fastening element on said at least one body supported piece, each of said pads being temporarily attachable to said at least one body worn piece and said pads being detachable from said body supported pieces by an impact against said pads;

an integrated sound effects producing system;

a head mounted piece;

a battery operated eye piece;

a decorative belt; and at least one simulated weapon having a hook and loop fastening element on a portion thereof for temporarily attaching to one of said pads.

* * * * *